United States Patent [19]

Eilenberg et al.

[11] 4,010,676

[45] Mar. 8, 1977

[54] APPARATUS FOR FORMING ARTICLES SUCH AS CARTON BLANKS

[75] Inventors: Jon Arthur Eilenberg, Goshen; George Henry Naugle, Nyack, both of N.Y.

[73] Assignee: International Paper Company, New York, N.Y.

[22] Filed: Apr. 4, 1975

[21] Appl. No.: 565,128

[52] U.S. Cl. ..... 93/51 R; 93/84 R

[51] Int. Cl.[2] ..... B31B 1/44

[58] Field of Search ..... 93/84 FF, 84 R, 51 R, 93/49 R

[56] References Cited

UNITED STATES PATENTS

| | | | |
|---|---|---|---|
| 432,028 | 7/1890 | Foglesong | 93/51 R |
| 440,570 | 11/1890 | Hott | 93/51 R |
| 502,320 | 8/1893 | Rice | 93/51 R |
| 1,548,231 | 8/1925 | Walker | 93/49 R |

*Primary Examiner*—Leon Gilden

*Attorney, Agent, or Firm*—Ronald A. Schapira

[57] ABSTRACT

An apparatus for forming articles such as paperboard cartons from a single piece blank, comprising a first article holding member containing a cut-out and a second article holding member adapted to mate with the cut out. A portion of the workpiece is grasped by the mating surfaces of the holding members. Article forming members are provided in which the ungrasped portions of the workpiece are cradled. The forming members are capable of mating in close fitting relationship about the holding members. As the forming members move towards the holding members, they move the ungrasped cradled portions of the workpiece against the lateral surfaces of the mated holding members, sandwiching them between the mated holding members and mated forming members. The mated holding members serve as a forming mandrel to impart the desired shape to the workpiece. By properly sizing the forming members, corner seals on items such as paperboard cartons can be formed as the forming members mate around the holding members. It has been found desirable to recess certain lateral surfaces of the first holding member relative to those of the second holding member, and to taper selected surfaces of the holding and forming members, as explained in greater detail herein.

14 Claims, 17 Drawing Figures

APPARATUS FOR FORMING ARTICLES SUCH AS CARTON BLANKS

BACKGROUND OF THE INVENTION

This invention relates to an apparatus for forming an article, and is particularly useful in the forming of cartons from a single unit blank. In general, this involves taking a pre-scored carton blank, usually made of a material such as rigid paperboard, and folding the blank along the various fold lines to shape the blank into a finished carton. Once this is done, portions of the blank are normally sealed together or otherwise joined to maintain the structural integrity of the formed carton.

The apparatus of the invention provides a quick and efficient means for erecting such pre-scored blanks into cartons and is particularly useful in erecting pre-scored carton blanks of the type described in commonly assigned copending U.S. Pat. Application, Ser. No. 456,368, filed Mar. 29, 1974 in the name of Robert L. Gordon, now U.S. Pat. No. 3,908,888, said copending application incorporated herein by reference. These cartons are characterized by a sloped bottom structure formed by two downwardly sloping suspended triangular segments which are foldably joined along their bottom edge. The formed carton is best shown in FIG. 11' of the accompanying drawings. The blank from which it is formed is shown in FIG. 1.

SUMMARY OF THE INVENTION

The apparatus of the invention comprises a pair of mateable article holding members and a pair of mateable article forming members which, when mated, enclose the article holding members in close fitting relationship. A portion of the article being formed is grasped between the mated surfaces of the holding members, with the remainder of the article being cradled by the unmated forming members located on each side of the holding members. As the forming members then move into mating relationship around the holding members, the ungrasped portions of the article are folded against the lateral surfaces of the mated holding members, which then act as a mandrel about which the ungrasped portions are formed.

More specifically, the apparatus comprises a first article holding member having a female cut-out, usually in its upper surface, which slopes downwardly on each side toward its center and is open at opposed ends thereof. In one embodiment, this first holding member is a four-sided, four-cornered member with the cut-out extending between diagonal corners thereof. The cut-out is formed by two sloped triangular surfaces joined along a common edge to form the bottom of the cut-out, with the two remaining edges of each triangular side formed by two intersecting sides of the first article holding member. A second article holding member, usually four-sided and four-cornered also, and disposed above the first member, is provided which contains a male portion adapted to mate with the cut-out carried by the first member. At least one of the holding members is mounted for movement, normally in a vertical direction, toward and away from the other member to alternately mate and unmate the members as desired. Means such as air-driven cylinders or the like are provided to move the holding members in and out of mating relationship.

The two article holding members function by mating about a portion of the article to be formed, e.g. a carton blank, to grasp that portion between the two mating surfaces and hold it stationary during the subsequent forming operations. The grasped portion of the article is contoured against the surfaces of the cut-out of the first member and is disposed between the surface of the cut-out and the surface of the mating male portion of the second member.

The apparatus further includes articles forming members which can mate to surround and enclose the lateral surfaces of the article holding members in close fitting relationship. In one embodiment, there are two forming members, one on each side of the cut-out. Each forming member is made up of two walls joined at a corner. As these forming members mate, a four-walled, four-covered structure is formed generally encircling and conforming to the four-cornered, four-sided article holding members they are mated about. The forming members are mounted for movement into and out of mating relationship about the holding members by means such as air-driven cylinders or the like.

The article forming members function by folding the portions of the workpiece not grasped by the holding members against the lateral surfaces of the mated holding members, with these non-grasped portions being located between the holding members and the forming members. The non-grasped portions then shape themselves about the mated holding members, which function as a forming mandrel, to produce the formed article. Cooperating portions of the forming members also apply pressure to various sealing surfaces of the article which join these surfaces together to maintain the structural integrity of the formed article.

To recover the formed article, the forming members are first unmated. The holding members are then also unmated and the formed article removed from the apparatus.

In one embodiment of the invention, an arrangement of cooperating tapers is provided on certain lateral surfaces of the first holding member and on the surfaces of the forming members which adjoin these tapered surfaces when the forming members are mated around the holding members. These tapers generally take the form of horizontal tapers on the holding members, and horizontal and vertical tapers on the forming members, with the horizontal tapers on the adjoining surfaces of the holding and forming members being generally parallel to each other, and the vertical tapers moving toward the holding member as the taper descends.

It has also been found that in addition to the tapers, it is often desirable that the lateral surfaces of the first article holding member be recessed with respect to the same surfaces of the second article holding member.

The tapering and recessing of the various surfaces, and the extent thereof, depend upon the pecularities of the article being processed on the apparatus, and are generally provided to obtain better folding or creasing of the article during forming, improved alignment of the sealing surfaces of the article, and to accommodate variable thicknesses of the article which arise as it is being formed.

The invention is described in greater detail below in conjunction with the specific embodiments shown in the accompanying drawings.

BRIEF DESCRIPTION OF THE DRAWINGS

FIGS. 9′–11′ correspond to FIGS. 9–11 except that all portions of the apparatus are eliminated, and are intended for a better showing of how the apparatus operates on the blank of FIG. 1 in the course of forming it into a carton.

FIGS. 9 and 9′ show the male and female article holding members of the apparatus in mated position grasping the central portion of the folded blank of FIG. 1.

FIGS. 10 and 10′ show the horizontally disposed article forming members of FIGS. 9 and 9′ beginning to move upwardly toward the mated male and female article holding members to initiate the formation of the bottom structure and wall structure of the carton.

FIGS. 11 and 11′ show the article forming members in a fully vertical erect position in mating relationship about the mated male and female article holding members, with the carton now fully formed in the apparatus. FIG. 11′ is partly cut away to better show the sloped internal bottom structure of the carton.

DESCRIPTION OF THE PREFERRED EMBODIMENTS

Figure 1:
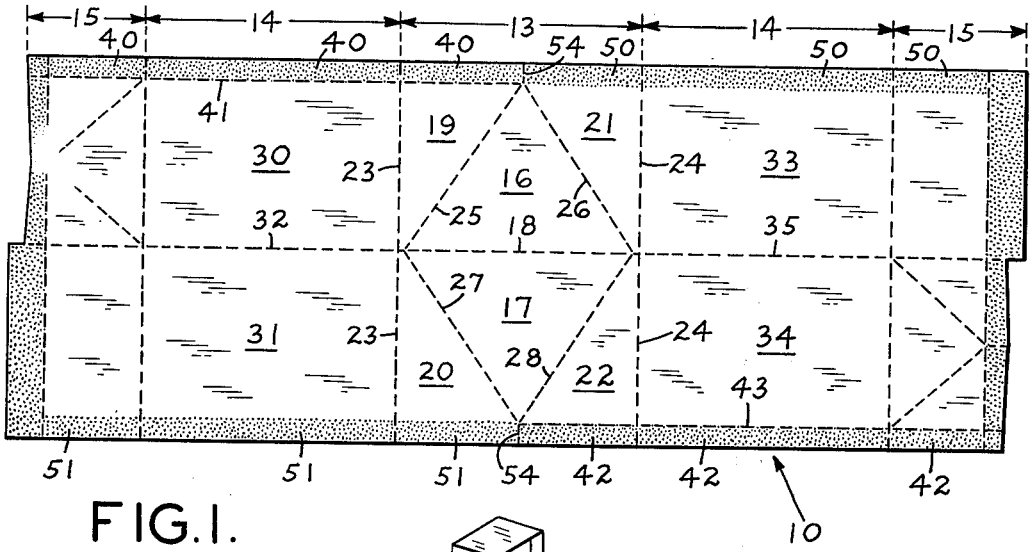
FIG. 1 is a plan view of a pre-scored carton blank which can be erected using the apparatus of the invention, with the shaded areas representing adhesive areas (or sealing surfaces) of the blank.
Figure 11:
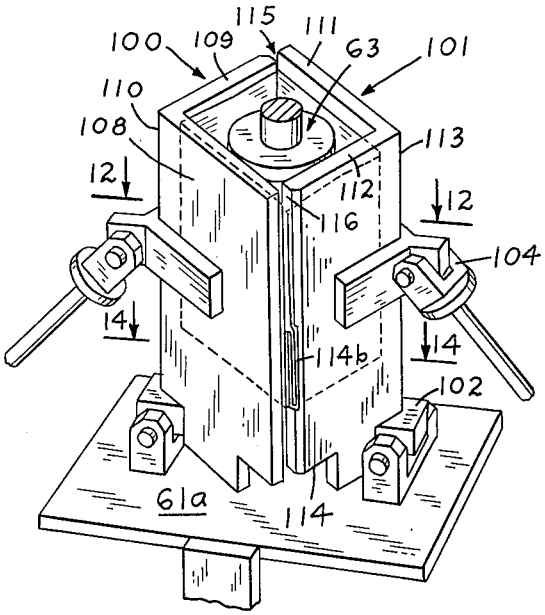
Figure 11:
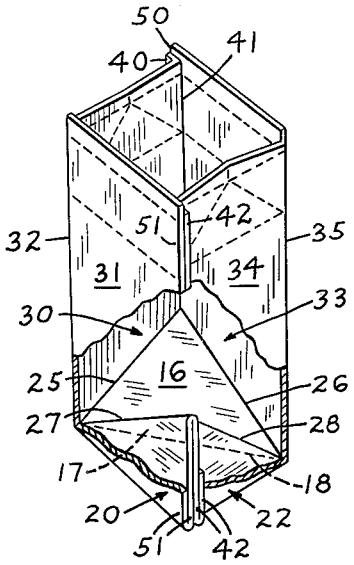

The apparatus of the invention is particularly suitable for erecting the rigid pre-scored polyethylene coated paperboard blank 10 shown in FIG. 1 into a carton having a sloped bottom and flanged, lateral exterior corner seals as shown in FIG. 11′. Blank 10 has three main components, a central bottom forming panel generally designated 13, wall panels generally designated 14 attached to opposite edges of panel 13, and top forming panels generally designated as 15 attached to the top of the wall panels 14.

The bottom forming panel 13 comprises two centrally located, large triangular bottom panels 16, 17 attached along a fold line 18, and four smaller triangular bottom support panels 19, 20, 21, 22. Panel 16 is attached to panels 19 and 21 by fold lines 25 and 26, respectively, while panel 17 is attached to panels 20 and 22 by fold lines 27 and 28, respectively.

Attached to oppostie sides of panel 13 along fold lines 23 and 24, respectively, is a first pair of wall panels 30 and 31 joined to each other along fold line 32, and a second pair of wall panels 33 and 34 joined to each other along fold line 35. The wall panel fold lines 32 and 35 form an extension of the fold line 18 of panel 13.

As shown in FIGS. 1 and 11′, the top forming panels 15 are adapted to form a conventional gable top. Any other suitable top closure familiar to those skilled in the art could be used such as, for example, a flat top closure. The top structure of the carton is relatively unimportant insofar as the apparatus of the invention is concerned since, as will become clearer below, the main function of the apparatus is to form the bottom and wall structure of the carton. Once this is done, the top structure can be formed in accordance with conventional techniques and apparatus.

Thin side sealing panels 40 (see FIG. 1) are attached along half of one edge of the blank 10 to panels 19 and 30 by fold lines 41. A second set of side sealing panels 42 are attached along the opposite half of the other edge to panels 22 and 34 by fold lines 43. Panels 21 and 33 have thin non-foldable extensions 50 similar to panels 40 while panels 20, 31 have similar extensions 51. Panels 40 and 42 join extensions 50 and 51, respectively, along fold lines 54.

The apparatus of the invention is best shown in FIGS. 2–8. The operative parts of the apparatus are mounted on a stationary framework generally designated 60 which comprises a lower horizontal platform 61, an upper horizontal platform 61a, and integral braced vertical members 62 for supporting the apparatus.

The apparatus comprises a stationary female article holding member 63 and a vertically moveable male article holding member 64 which is adapted to mate with member 63. The female member 63, as best seen in FIGS. 2, 3 and 5–8, is mounted on a pedestal 63a resting on platform 61a and has four lateral sides 65, 66, 67, 68 and four corners 69, 70, 71, 72 (see FIG. 5). The top surface of member 63 contains a cut-out 74 (see FIGS. 2 and 3) open at its opposite ends 75, which extends across the top of member 63 between the diagonal corners 69 and 71 thereof (see FIG. 5). The cut-out itself is formed by two downwardly sloping triangular surfaces 77, 78 (see FIG. 5) connected along a first common edge 79 which forms the bottom of the cut-out. The other two edges of triangular surface 77 are formed by the intersecting sides 65 and 68 of member 63 while the other two edges of triangular surface 78 are formed by intersecting sides 66, 67. The dimensions of surfaces 77, 78 are approximately the same as those of the triangular bottom panels 16, 17 of blank 10 (see FIG. 1) since cut-out 74 is designed so that panels 16, 17 of the blank are positioned against surfaces 77, 78, as explained more fully below.

Figure 3:
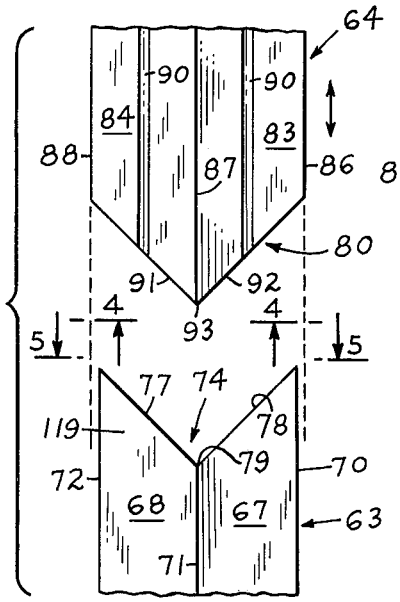
FIG. 3 is a side view taken generally along the line 3—3 of FIG. 2 (with the folded blank removed) showing only the article holding members in their unmated position, and emphasizing the recessing of the lateral surfaces of the female article holding member relative to those of the male article holding member.
Figure 4:
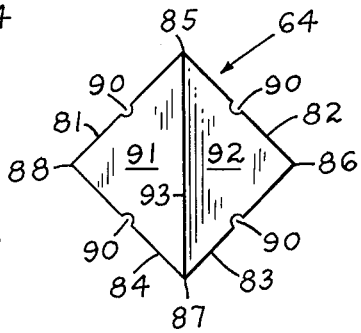
FIG. 4 is a view of the male article holding member taken generally along the line 4—4 in FIG. 3.
Figure 5:
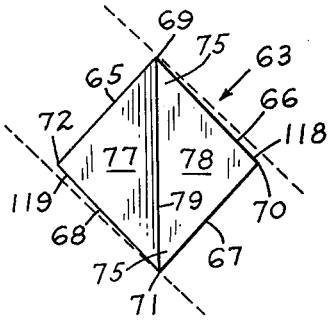
FIG. 5 is a view of the female article holding member taken generally along the line 5—5 of FIG. 3, emphasizing the horizontal tapers on two opposed lateral surfaces thereof.

Mating with the female cut-out 74 in member 63 is a portion of the male moveable article holding member 64 generally designated as 80 (see FIG. 3). Member 64 also has four lateral sides 81, 82, 83, 84 and four corners 85, 86, 87 and 88 (see FIG. 4). Each side contains an elongated centrally disposed vertical surface groove 90 to facilitate the separation of the formed article from member 64, as will become clearer hereinbelow. The mating male portion 80 of member 64 is formed by two downwardly sloping triangular surfaces 91, 92 connected along a first common edge 93 (see FIGS. 3, 4). The other two edges of surface 91 are formed by intersecting sides 81 and 84 of member 64, while the other two edges of surface 92 are formed by intersecting sides 82 and 83. The dimensions of surfaces 91, 92 are slightly greater than those of their mating surfaces 77, 78 of the female member 63, as discussed in more detail below.

Figure 9:
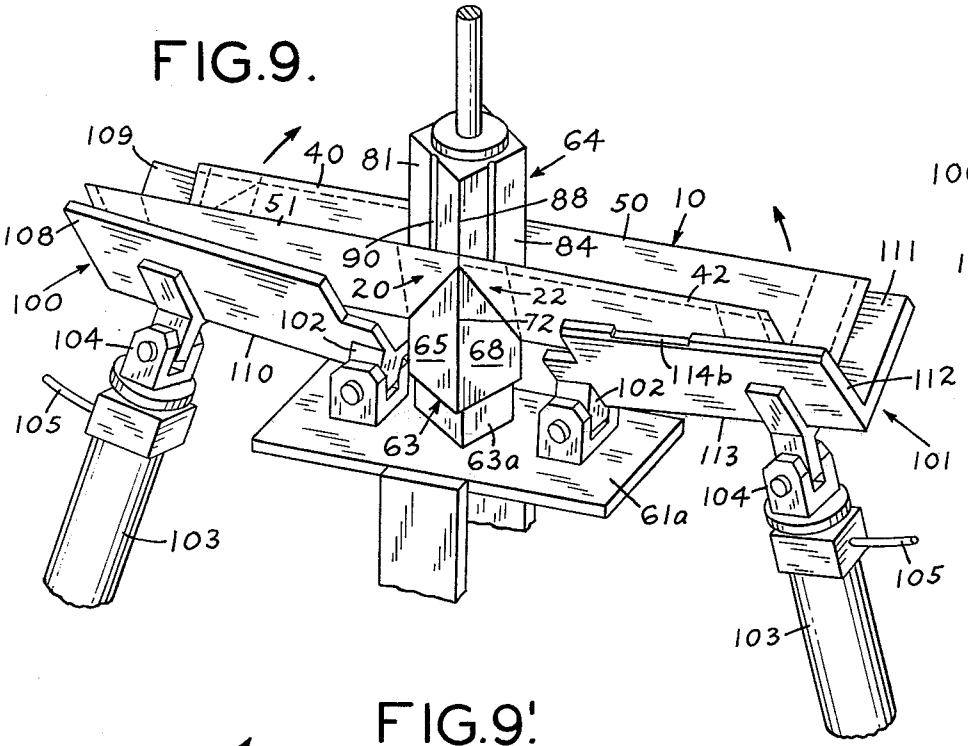
Figure 9:
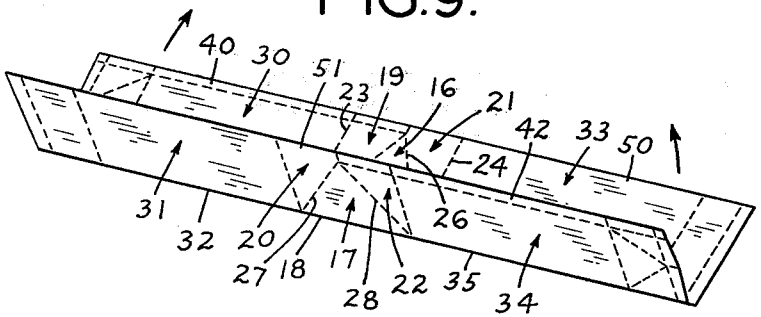

Male member 64 is mounted on the frame member 62 for vertical reciprocal movement into and out of mating relationship with the cut-out 74 of member 63. This movement is accomplished by an air driven cylinder 95 (FIG. 2) whose piston rod connects to member 64. Cylinder 95 is equipped with a conventional pressurized air inlet and exhaust system 96. Upon actuation from its position shown in FIG. 2, the cylinder 95 drives male member 64 downward into mating relationship with the stationary female member 63 as shown in FIG. 9. Air pressure can also be applied to cylinder 95 to raise male member 64 out of mating relationship with member 63.

Mating article holding members 63, 64 close on the triangular bottom panels 16, 17 which have been partially pre-folded toward each other along central fold line 18 so that panels 16, 17 are sandwiched between the mating triangular surfaces of male portion 80 and female cut-out 74, with the triangular surfaces of portion 80 and cut-out 74 generally indexed with the triangular panels 16, 17 (see FIGS. 9 and 9'). This holds panels 16, 17 stationary thereby permitting other blank folding operations to take place which form the erected carton. After forming, the article holding members are unmated so the erected carton can be removed from the apparatus.

The apparatus further includes a pair of article forming members 100, 101 (see FIGS. 2, 6, and 7) mounted at their base to platform 61a by pivots generally designated as 102, so they can be raised and lowered as desired in response to the actuation of the air-driven cylinders 103 to which they are each pivotally mounted at 104. Cylinders 103 are similar to cylinders 95 discussed above and are also provided with a conventional air inlet and exhaust system 105. Cylinders 103 are pivotally mounted to platform 61 at 106.

Figure 6:
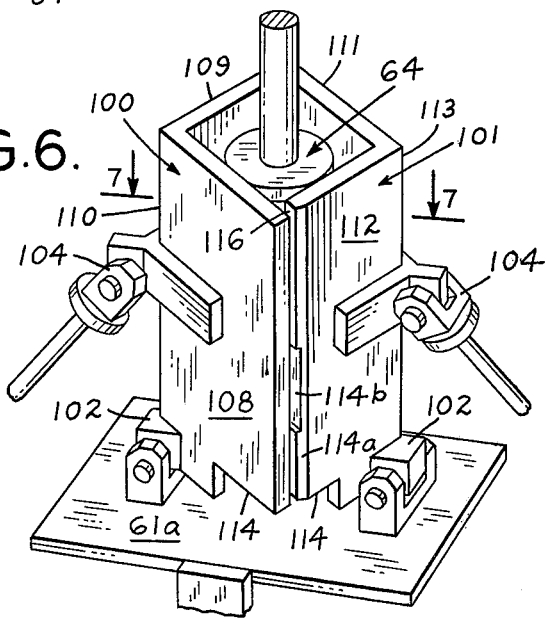
FIG. 6 is a view similar to FIG. 2 with the carton blank and certain portions of the apparatus removed, showing the article forming members in mated position about the mated article holding members.
Figure 7:
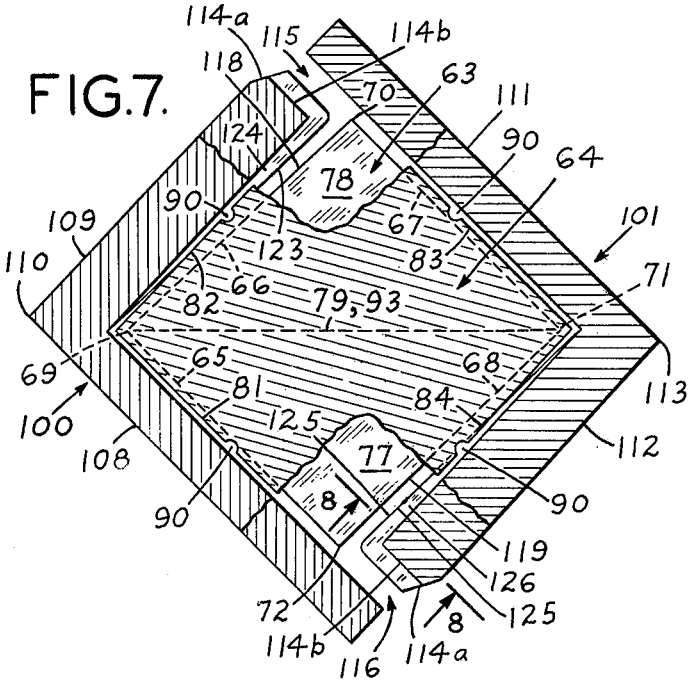
FIG. 7 is a plan sectional view taken generally along the line 7—7 of FIG. 6 (with the carton blank removed), partly cut away to a lower level to expose portions of the female article holding member to better show the recessed surfaces of the female article holding member relative to those of the male article holding member, and the tapered surfaces of the female article holding member and adjoining portions of the article forming members.

Article forming member 100 has two walls, a long wall 108 and a short wall 109 which meet to form a corner 110 as best seen in FIGS. 6 and 7. As shown in these Figures, wall 108 extends a longer distance from corner 110 than does the shorter wall 109. Similarly, article forming member 101 has a long wall 111 and a short wall 112 which meet to form a corner 113. Walls 108, 109, 111, 112 are each provided with relief cut-outs 114 at their base which facilitate the mating of the forming members about the holding members. Walls 109 and 112 are provided with a vertically extending bevel **114*a* at their free edge and a relief cut-out 114*b* near the bottom of the free edge which faces the long walls 111 and 108, respectively, when members 100 and 101 are mated. The purpose of the relief cut-outs 114*b*** will become apparent hereinbelow.

As best seen in FIGS. 6 and 7, members 100, 101, when raised to their vertical position, are adapted to mate and, when mated, to enclose the mated article holding members 63, 64 in close fitting relationship. In their mated position, the long walls 108, 111 of each member 100, 101 oppose each other as do the short walls 109, 112 of each member.

Two thin vertical "gaps" 115, 116 (see FIG. 7) are provided between the adjoining extremities of the long and short walls of different article holding members. As will appear below, the side sealing panels 40, 42 and the non-foldable sealing extensions 50, 51 of the blank 10 (see FIG. 1) come together in these gaps and are pressed together to join them in sealing relationship as the end of each short wall pushes against the end of its adjoining long wall in an effort to reduce the width of the gaps 115 and 116.

Returning again to the male and female article holding members 63, 64, it can be seen in FIGS. 3 and 7 that the four lateral sides, 65, 66, 67 and 68 of female member 63 are slightly recessed with respect to the corresponding lateral sides 81, 82, 83, 84 of the male member 64. This is best seen in FIG. 7 which shows that the sides 81, 82, 83, 84 of the top male member 64 extend outwardly beyond the sides 65, 66, 67, 68 of the underlying female member 63. Furthermore, the inwardly recessed surfaces on the two opposed sides 66 and 68 which adjoin the short walls 109, 112 of members 100, 101 when members 100, 101 are mated (as in FIGS. 6 and 7) each contain a horizontal taper best shown in FIGS. 5, 7 and 8. Taper 118 on side 66 has its thinnest width in proximity to the diagonal corner 69 which forms one end 75 of the cut-out 74, while the horizontal taper 119 on recessed side 68 has its thinnest width in proximity to the diagonal corner 71 which forms the other end 75 of cut-out 74. It is seen that tapers 118 and 119 are substantially parallel to each other, with each having its thinnest dimension at a corner which forms an end of the cut-out 74. The tapers 118, 119 on the female member 63, as shown in FIG. 7, taper inwardly away from mated forming members 100, 101 as the tapers advance from corners 69, 71 toward the corners 70, 72, respectively.

Figure 8:
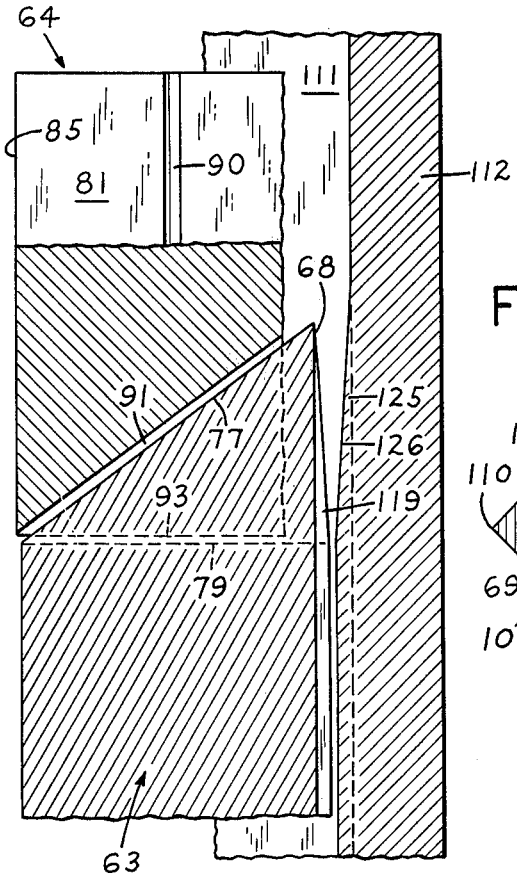
FIG. 8 is a sectional view, with certain parts omitted for improved clarity, taken generally along the line 8—8 of FIG. 7, to better show the tapered surfaces on the female article holding member and adjoining portions of the article forming members.

Cooperating with the horizontal tapers 118 and 119 are similar horizontal tapers on the inner surfaces of the short walls 109 and 112 of forming members 100 and 101 which adjoin the tapered portions of the female member 63 when members 100, 101 are mated around member 63. Thus, as best seen in FIGS. 7 and 8, short wall 109 has a horizontal taper 123 having its thinnest width in proximity to corner 110 where it joins long wall 108. Similarly, short wall 112 has a horizontal taper 125 having its thinnest width in proximity to corner 113 where it joins long wall 111. As in the case of the tapers on member 63, the horizontal tapers 123 and 125 are substantially parallel to each other. Tapers 123 and 125 are also substantially parallel to their adjoining tapers 118 and 119, respectively, on the female member 63. The horizontal tapers 123, 125 taper inwardly toward member 63 when members 100, 101 are mated around member 63 with the taper increasing in width as the taper moves away from the corners 110, 113 of members 100, 101.

The short walls 109 and 112 of forming members 100 and 101 are also each vertically tapered as best shown in FIG. 7. This vertical tapering, in conjunction with the horizontal tapering, provides a compound taper on walls 109 and 112, i.e. a taper which extends in two generally perpendicular directions. Thus short wall 109 has a vertical taper 124 having its thinnest width at its top. Similarly, short wall 112 has a vertical taper 126 having its thinnest width at its top. Vertical tapers 124 and 126 taper toward each other, and inwardly toward member 63 when the forming members 100 and 101 are mated around member 63, with the thickness of the tapers 124 and 126 increasing as they descend from top to bottom.

The angle of the various tapers depends upon factors such as the thickness of the blank involved and other characteristics of the blank, but generally is between about ½° to 3 degrees. The purpose of recessing the four lateral sides of the female member 63 relative to those of the male member 40 is explained in more detail below, and generally relates to the fact that a double thickness of paperboard is sandwiched between the female member 63 and members 100, 101 while only a single thickness is sandwiched between the male member 64 and members 100, 101. The various tapered surfaces in the apparatus are generally provided to obtain uniformly aligned side seals in the finished carton and sharp folding or creasing in the bottom structure of the blank.

Figure 2:
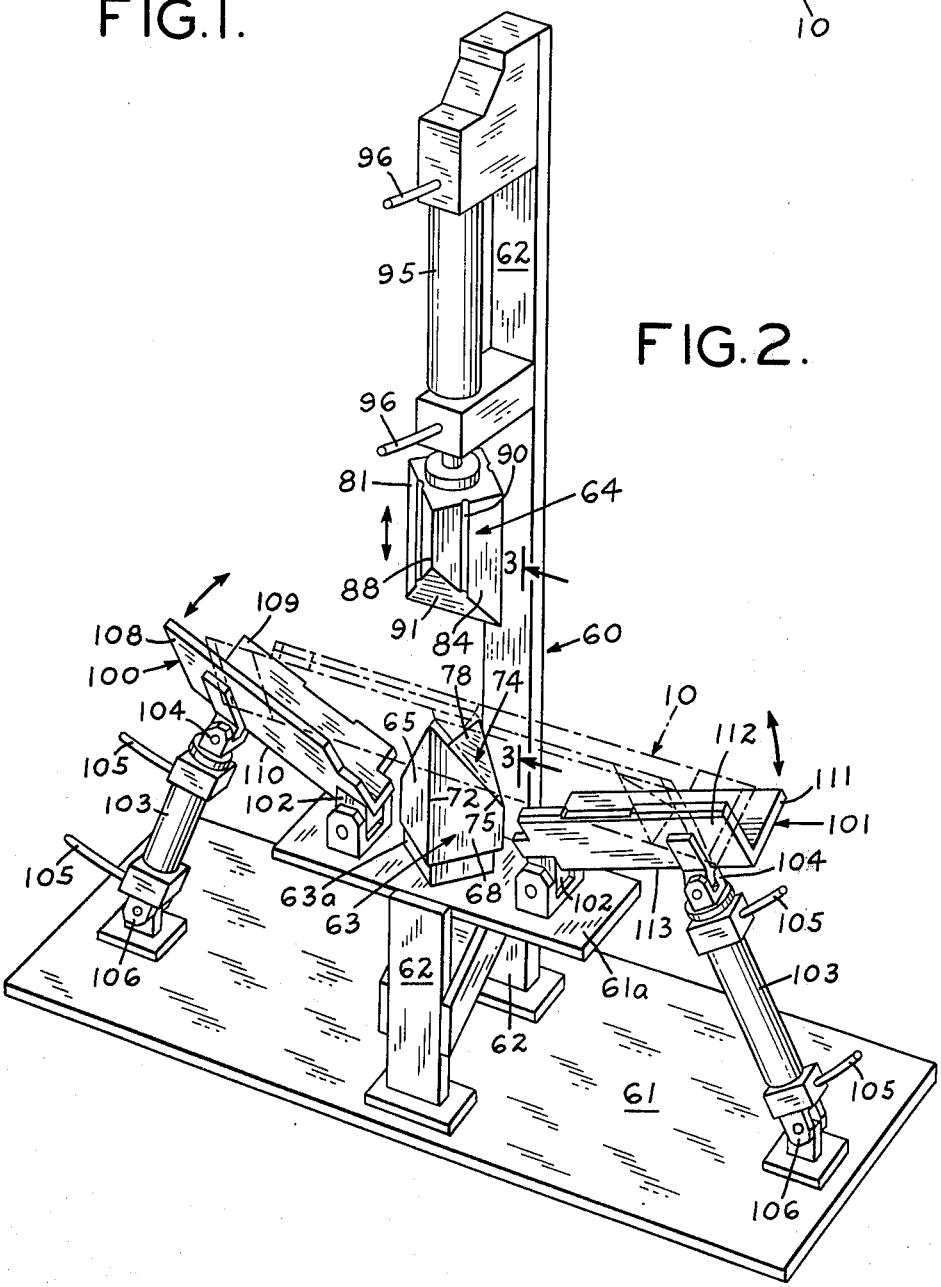
FIG. 2 is a perspective view of the apparatus of the invention with the blank of FIG. 1 shown (in phantom lines) folded in half along its elongated center fold line to illustrate the initial step in the erection of the blank.

The use of the apparatus to form a blank is shown sequentially in FIGS. 2 and 9 (9') through 11 (11'). Prior to placing the blank of FIG. 1 in the apparatus, the shaded areas thereof are rendered adhesive in any suitable manner. For example, in the case where the blank material is a thermoplastic coated paperboard, hot air can be blown onto the blank to heat activate the thermoplastic and render it adhesive. Alternatively, any suitable adhesive could be applied to the shaded sealing areas of the blank. As will appear below, it is also desirable to render adhesive the outer side (i.e. the side not shown in FIG. 1) of the shaded portions of the bottom forming panel 13.

The pre-treated blank is then folded in half along centrally disposed fold lines 18, 32 and 35 to move the inner surfaces (i.e. the surfaces shown in FIG. 1) of each half toward each other until the blank 10 is folded into the V-shaped configuration shown in FIG. 9'. The folded blank is then placed in the female cut-out 74 of unmated member 63, with the triangular bottom panels 16, 17 of the blank generally overlying the triangular surfaces 77, 78 of cut-out 74. The wall panels 30, 31, 33, 34 of the blank are cradled by the horizontally disposed article forming members 100, 101, with the male article holding member 64 in its elevated unmated position (as best shown in FIG. 2).

Pressure is then applied to air cylinder 95 causing male member 64 to descend into mating relationship with the slot 74 of female member 63 with the triangular panels 16, 17 of blank 10 sandwiched between the mated article holding members 63, 64 and gripped thereby as shown in FIG. 9. The gripping of the blank is sufficiently tight to hold panels 16, 17 stationary during the remainder of the folding and sealing operations of the apparatus.

Figure 10:
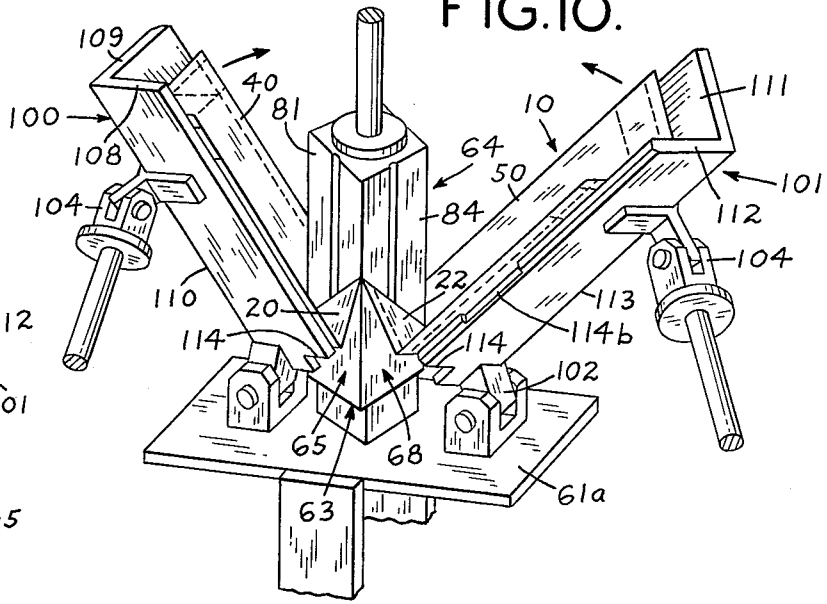
FIGS. 9–11 are views similar to FIG. 1, with certain parts omitted, showing sequentially the formation of the blank of FIG. 1 into a carton on the apparatus of the invention.
Figure 10:
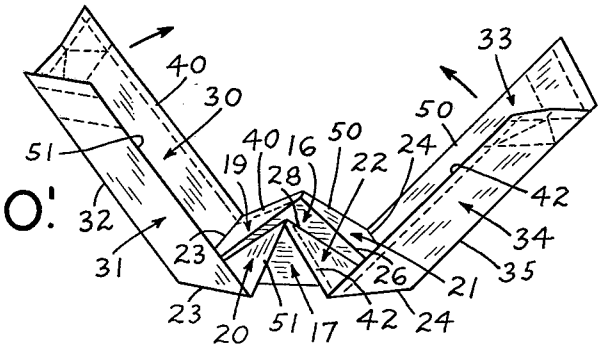

Pressure is next applied to air cylinders 103 causing the two article forming members 100, 101 to move upwardly about pivots 102 toward their eventual vertical mated position around mated members 63, 64, as best shown in FIG. 10. As members 100, 101 begin to rise, they also move the cradled wall structure of the blank upwardly with them. As this occurs, the wall panels 30, 31, 33, 34 fold along their base fold lines 23, 24 and move toward the mated members 63 and 64 while the triangular bottom support panels 19, 20, 21, 22 of blank 10 simultaneously fold along their fold lines 25, 27, 26, 28, respectively, (as best seen in FIGS. 10, 10') causing the outer surfaces of each panel to move toward its respective side 65, 66, 67 or 68 of the female member 63. It is seen that sides 65, 66, 67, 68 each have a triangular configuration generally conforming to that of the triangular bottom support panels 19, 20, 21, 22 being forced against them.

As the article forming members 100 and 101 continue to rise, they eventually reach the fully erect position shown in FIG. 11. At this point, the triangular bottom support panels 19, 20, 21, 22 are pressed against the four triangular sides 65, 66, 67, 68 of the female member 63. The lower portions of wall panels 30, 31, 33, 34 are sandwiched between the bottom support panels 19, 20, 21, 22, respectively, and the article forming members 100, 101 to provide a double thickness of paperboard in the lower portion of the apparatus in proximity to the member 63, as best shown in FIGS. 10, 10', 12, 13 and 14. The upper portions of wall panels 30, 31, 33, 34 are sandwiched between the male member 64 and the article forming members 100, 101 to provide a single thickness of paperboard in the upper portions of the apparatus in proximity to member 64, as best shown in FIGS. 10, 10', 12 and 13. The upper portion of each wall panel 30, 31, 33, 34 is pressed against a side 81, 82, 83, 84 of male member 64.

As the article forming members 100, 101 assume their fully mated positions around the mated members 63, 64, as shown in FIG. 11, the extremities of the short and long walls 109 and 111 of members 100 and 101, respectively, on opposite sides of the gaps 115 (see FIGS. 7, 11, 12, and 14) cooperate to locate the thin foldable, adhesive side sealing panels 40 of panels 19 and 30 and the non-foldable, sealing adhesive extensions 50 of panels 21 and 33 in gap 115, and then fold panels 40 along fold lines 41 so that panels 40 and extensions 50 come into face contact. Panels 40 and extensions 50 are then pressed together by the converging extremities of members 100, 101 to form a flanged vertical seal along one entire corner of the carton (see FIG. 11'). While the upper portions of the flanged seal are of double paperboard thickness, the lower portions are of quadruple thickness since they include the sealing panel 40 and extension 50 of the triangular bottom support panels 19 and 21, respectively, plus the lower portions of the sealing panel 40 and extension 50 of the wall panels 30 and 33, respectively. This is best shown in FIGS. 10', 12 and 14. The relief cut-out **114*b* (FIGS. 9, 10, 11, 12 and 14) is provided in the lower portion of the surface which forms the free extremity of the short walls 109 and 112 of article forming members 100 and 101, respectively, to accommodate this quadruple seal thickness. Sealing panels 40 of the triangular bottom support panel 19 and of the wall panel 30 occupy the cut-out 114*b* (see FIGS. 12 and 14) and thereby allow the upper portions of the extremities of the walls 109 and 111 to close tightly against, and seal, the portions of panel 40 and extensions 50 at the upper part of the carton structure, where only a double thickness seal is used. If the cut-out 114*b* was not provided, the thickness of the quadruple seal at the bottom of the carton would prevent the extremities of the walls 109 and 112 from closing tightly against the double thickness seal at the top of the carton. Of course, the cut-out 114*b* could be provided in either the long or the short walls of the members 100 and 101**, or in both the long and the short wall.

In similar manner, the extremities of the short and long walls 112 and 108 on opposite sides of the gap 116 (see FIGS. 7, 11, 12 and 14) cooperate to locate the thin, foldable, adhesive side sealing panels 42 of panels 22 and 34 and the nonfoldable, adhesive sealing extensions 51 of panels 20 and 31 in gap 116, and then fold panels 42 along fold line 43 so that panels 42 and extensions 51 come into face contact. Panels 42 and extensions 50 are then pressed together by the converging extremities of members 100, 101 to form a second flanged vertical seal along a corner edge of the carton (see FIG. 11') diagonally opposite the flange seal formed by panels 40 and extensions 50. While the upper portions of the second flange seal are of double paperboard thickness, the lower portions are of quadruple thickness since they include the sealing panel 42 and extension 51 of the triangular bottom support panels 22 and 20, respectively, plus the lower portions of the sealing panel 42 and extension 51 of the wall panels 34 and 31, respectively. This is best shown in FIGS. 10', 12 and 14. The relief cut-out **114*b* serves the same purpose in gap 116 as previously described for gap 115, namely to allow the extremities of the walls 108 and 112 to close tightly against, and seal, the portions of panels 42 and extensions 51** at the upper part of the carton structure, where only a double thickness seal is used.

In the lower quadruple seal formed in gap 115, panel 40 of triangular panel 19 is sealed on one side to panel 40 of wall panel 30 and on the other side to extension 50 of triangular panel 21. Extension 50 of triangular panel 21 is sealed to the extension 50 of wall panel 33 on its other side. In the lower quadruple seal formed in gap 116, panel 42 of triangular panel 22 is sealed on one side to panel 42 of wall panel 34 and on the other side to extension 51 of triangular panel 20. Extension 51 of triangular panel 20 is sealed to the extension 51 of wall panel 31 on its other side. The joining of the various surfaces of panels 40, 42 and extensions 50, 51 is best seen in FIGS. 10', 12 and 14.

Figure 12:
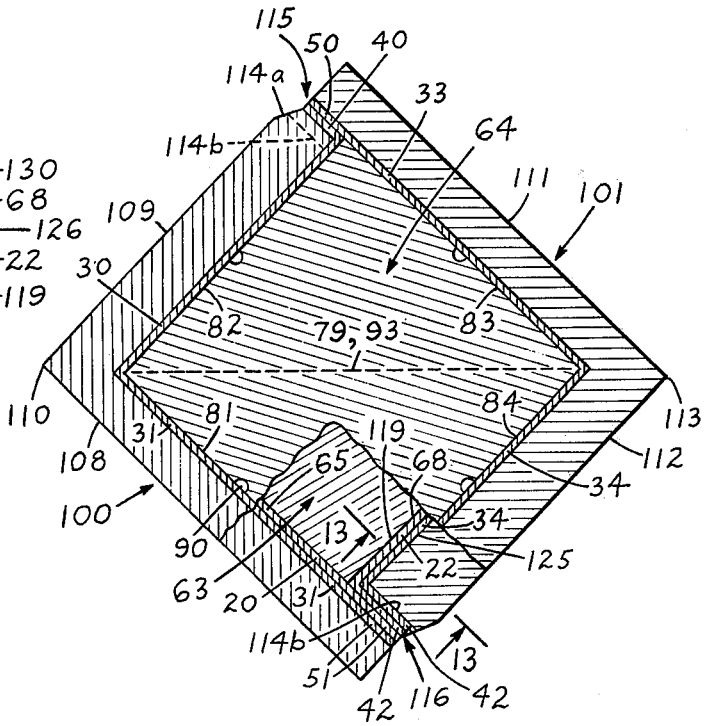
FIG. 12 is a sectional view taken generally along the line 12—12 of FIG. 11 and is similar to FIG. 7 except that (1) the cut-away portion is at a lower level than the cut-away portions of FIG. 7, (2) the paperboard blank is included in FIG. 12, and (3) only one of the corners is cut away. The corner sealing of the upper portion of the carton (two thicknesses of paperboard) is shown in the upper corner, and the corner sealing of the lower portion of the carton (four thicknesses of paperboard) is shown in the lower cut-away corner.
Figure 14:
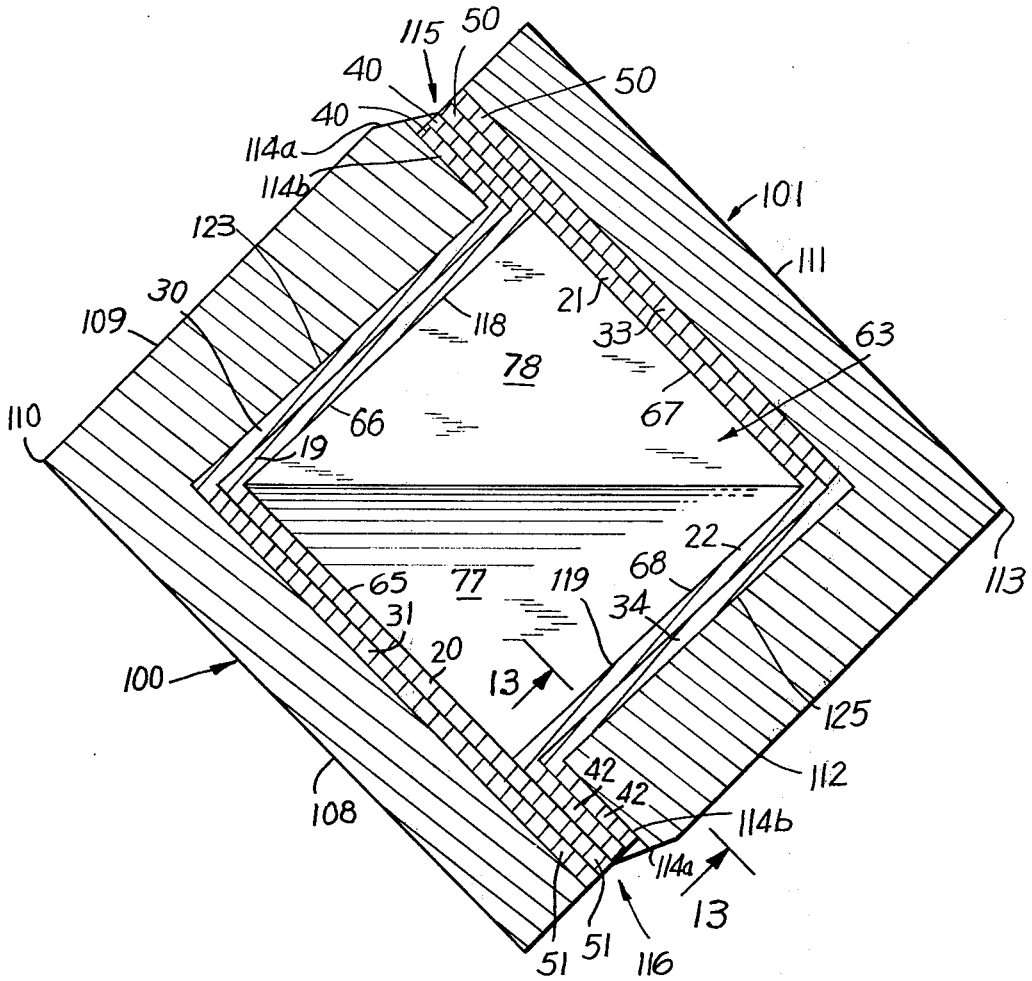
FIG. 14 is an enlarged sectional view taken generally along the line 14—14 of FIGS. 11 and 13 (line 14–14 passes through the relief cut-outs 114*b* and follows the sloped upper surface of the female article holding member) and is intended for a better showing of the lower portions of the blank and apparatus shown in the cut-away portion of FIG. 12, highlighting the quadruple thickness of paperboard which is sandwiched between the mated article holding members and the mated article forming members to form the lower corner seals.

As best shown in FIGS. 12 and 14, the cooperating horizontal tapers 118, 119 (on member 63) and 123, 125 (on members 109, 112) provide uniformly aligned flanged corner seals by assuring that the foldable sealing panels 40 and 42 are not pushed further out than the adjoining extensions 50 and 51 to which they are sealed. This uniformity is shown in FIGS. 12 and 14 by the fact that in gap 115 the edges of panels 40 are flush with, instead of extending past, the edges of extensions 50, while in gap 116 the edges of panels 42 are flush with, instead of extending past, the edges of extensions 51. It has been found if the horizontal tapers are not provided, the foldable panels 40, 42 do not remain flush with extensions 50, 51 and produce a flange seal which, though perhaps not aesthetically acceptable, is an acceptable seal from a functional point of view.

Figure 13:
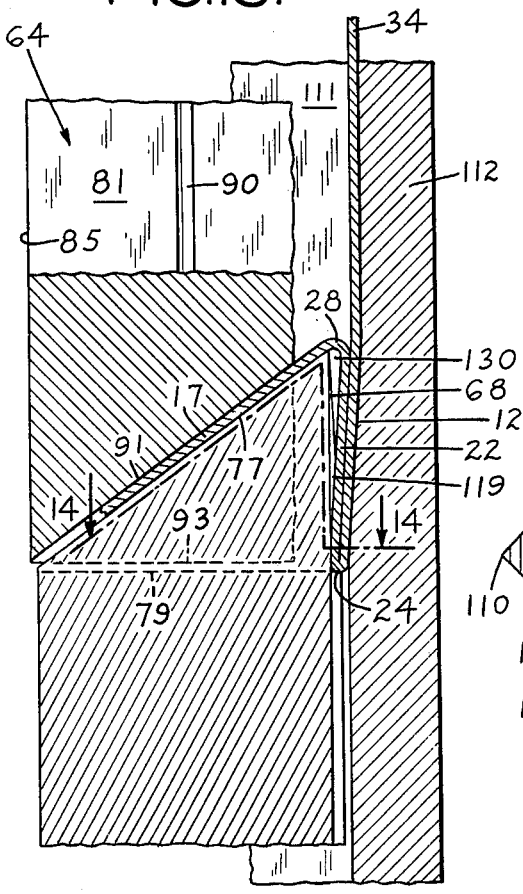
FIG. 13 is a sectional view taken along line 13—13 of FIG. 12 and is identical to FIG. 8 except that the paperboard blank is included in FIG. 13.

The vertical tapers 124 and 126 on the inner surfaces of the forming walls 109 and 112 tuck the lower portions of the blank in tightly against the sides of the female member 63, as best shown in FIG. 13. This provides sharp fold or crease lines which contribute to the overall pleasing appearance of the carton.

The vertical taper arrangement also provides a small air space 130 toward the top of female member 63 (see FIG. 13) between the folded paperboard and member 63 which facilitates removal of the erected carton from member 63. If these vertical tapers are not provided, it has been found that the carton can be removed from member 63 only with great difficulty, in some cases rupturing the seals.

Once the carton has been formed as in FIGS. 11, 11', members 100, 101, are retracted to their horizontal positions as shown in FIGS. 2 and 3. The male member 64 is then raised to its unmated position shown in FIG. 2. During unmating, the vertical grooves 90 in the surfaces of member 64 facilitate the smooth sliding release of member 64 from the carton walls which have been pressed against it. The erected carton is then supported on the female member 63 with the bottom panels 16, 17 resting in the cut-out 74 and the bottom support panels flush against the vertical sides of members 63. The carton is removed from member 63, after which it is filled and its top closure formed in accordance with known procedures.

The carton itself is best seen in FIG. 11'. The bottom structure comprises the two triangular bottom panels 16, 17 which slope downwardly to a common connecting edge 18. The bottom panels 16, 17 are attached to the wall panels by the triangular bottom support panels 19, 20, 21, and 22 which stand vertically erect in face-to-face contact with the inner surface of their adjoining wall panel. Vertical triangular panels 19, 20, 21 and 22 are disposed peripherally about the bottom panels 16, 17 of the carton where they support two of the three edges of each bottom panel, thereby forming a V-shaped bottom for the carton which is suspended from the bottom support panels 19, 20, 21 and 22.

The detailed and specific information presented above is by way of illustration only, and such alternations and modifications thereof as would be apparent to those skilled in the art are deemed to fall within the scope and spirit of the invention, bearing in mind that the invention is defined only by the following claims.

We claim:

1. An apparatus for forming an article comprising:

a first article holding member containing therein a cut-out portion sloped downwardly on each side toward its center and open at opposed ends thereof;

the cut-out portion in said first article holding member comprising two downwardly sloped triangular sections joined along a first common edge which forms the bottom of the cut-out portion and the remaining two edges of each of said triangular sections being formed by two intersecting sides of said first article holding member;

a second article holding member adapted to mate with the cut-out portion of the first member, at least one of said article holding members mounted for movement toward and away from the other to mate and unmate said members;

means for moving said article holding members into and out of mating relationship;

mating article forming members which, when mated, enclose the article holding members in close fitting relationship, said article forming members mounted for movement into and out of mating relationship about said article holding members; and means for moving said article forming members into and out of mating relationship about said article holding members.

2. The apparatus of claim 1 wherein the surfaces of the first article holding member are inwardly recessed with respect to the surfaces of the second article holding member.

3. The apparatus of claim 2 wherein two opposed recessed surfaces of the first article holding member have a horizontal taper.

4. The apparatus of claim 3 wherein the portion of the article forming members which adjoin the tapered surfaces of the first article holding member when the article forming members are mated has a horizontal and vertical taper, the horizontal taper conforming to the horizontal taper of the first article holding member.

5. The apparatus of claim 4 wherein the first and second article holding members each have four sides and four corners.

6. The apparatus of claim 5 wherein the cut-out in said first article holding member comprises two downwardly sloped triangular sections joined along a first common edge which forms the bottom of the cut-out portion, and wherein the remaining two edges of each triangular section are formed by two intersecting sides of the first article holding member.

7. The apparatus of claim 6 wherein the mating portion of the second article holding member comprises two downwardly sloped triangular sections joined along a common edge which is adapted to seat in the bottom of the cut-out of the first article holding member, and wherein the remaining two edges of each triangular section are formed by two intersecting sides of the second article holding member.

8. The apparatus of claim 7 wherein the horizontal tapers are substantially parallel with each other and wherein the vertical taper has its thinnest width at its top.

9. The apparatus of claim 8 wherein the angle of each taper is about ½° to 3°.

10. An apparatus for forming an article comprising:

a first four-sided, four-cornered article holding member containing therein a cut-out portion sloped downwardly on each side toward its center, said cut-out portion being open at opposed ends thereof and extending between diagonal corners of the member;

a second four-sided, four-cornered member having a portion adapted to mate with the cut-out portion of the first member, at least one of said article holding members mounted for movement toward and away from the other to mate and unmate said members;

means for moving said article holding members into and out of mating relationship;

mating article forming members which, when mated, enclose the article holding members in close fitting relationship, said article forming members mounted for movement into and out of mating relationship about said article holding members, each of said members comprising a long wall and a short wall adapted to adjoin two of the four sides of the article holding members when said article forming members are mated;

the sides of the first article holding member being inwardly recessed with respect to the sides of the second article holding member;

the short walls and the recessed sides of the first article holding member which adjoin the short walls when the article forming members are mated each having a horizontal taper, with said horizontally tapered short walls also having a vertical taper.

11. The apparatus of claim 10 wherein at least one of said walls comprising each article forming member contains a relief cut-out at its base, in a surface thereof forming a free extremity of the wall.

12. An apparatus for forming an article comprising:

a first four-sided, four-cornered article holding member having therein a cut-out portion adapted downwardly on each side toward its center, said cut-out portion being open at opposed ends thereof and extending between two diagonal corners of the member, each side of said cut-out portion comprising a triangular segment, said segments connected along a first edge thereof forming the bottom of the cut-out, the second and third edges of each segment formed by two intersecting sides of the first article holding member;

a second four-sided, four-cornered article holding member adapted to mate with the cut-out portion of the first member, at least one of said article holding members mounted for movement toward and away from the other to mate and unmate said members;

means for moving said article holding members into and out of mating relationship;

mating article forming members which, when mated, enclose the article holding members in close fitting relationship, said members mounted at opposed sides of said cut-out portion, each comprising a long wall and a short wall joined to form a corner, the long and short walls of the first article forming member opposing the respective long and short walls of the second article forming member when the members are in mated position around the article holding members, at least one of said walls containing a relief cut-out at its base, in a surface thereof forming a free extremity of the wall.

means for moving said article forming members into and out of mating relationship about said article holding members;

said first article holding member having its sides inwardly recessed with respect to the sides of the second article holding member, the two opposed sides of the first article holding member adjoining the short walls of the article forming members when said article forming members are mated each having a horizontal taper, each taper having its thinnest width in proximity to one of said diagonal corners of the first article holding member;

said short walls of said article forming members having a horizontal and vertical taper in the portion thereof which adjoins the first article holding members when said article forming members are mated, each horizontal taper having its thinnest width in proximity to the corner of said short wall with the long wall, said vertical taper having its thinnest width at its top.

13. The apparatus of claim 12 wherein the angle of each taper is about ½° to 3°.

14. The apparatus of claim 12 wherein the horizontal tapers on the first article holding member and on the short walls of said article forming members are all substantially parallel when the article forming members are mated about the article holding members.

* * * * *

UNITED STATES PATENT AND TRADEMARK OFFICE

CERTIFICATE OF CORRECTION

PATENT NO. : 4,010,676

DATED : March 8, 1977

INVENTOR(S) : Jon Arthur Eilenberg et al.

It is certified that error appears in the above-identified patent and that said Letters Patent are hereby corrected as shown below:

at column 9, line 36, "nonfoldable" should be -- non-foldable -- ; and at column 12, line 36, "adapted" should be -- sloped -- .

Signed and Sealed this

Tenth Day of May 1977

[SEAL]

*Attest:*

RUTH C. MASON
*Attesting Officer*

C. MARSHALL DANN
*Commissioner of Patents and Trademarks*